US009464374B2

(12) United States Patent
Seo et al.

(10) Patent No.: US 9,464,374 B2
(45) Date of Patent: Oct. 11, 2016

(54) PULSATOR DEVICE USABLE WITH WASHING MACHINE AND WASHING MACHINE HAVING THE SAME

(75) Inventors: Dong Pil Seo, Suwon-si (KR); Jae Ryong Park, Hwaseong-si (KR); Sang Yeon Pyo, Suwon-si (KR); Hyun Sook Kim, Suwon-si (KR); Hwang Mook Cho, Hwaseong-si (KR); Ji Yu Lee, Incheon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 822 days.

(21) Appl. No.: 12/923,075

(22) Filed: Aug. 31, 2010

(65) Prior Publication Data

US 2011/0094271 A1 Apr. 28, 2011

(30) Foreign Application Priority Data

Oct. 22, 2009 (KR) ..... 10-2009-100644

(51) Int. Cl.

*D06F 13/08* (2006.01)
*D06F 13/06* (2006.01)
*D06F 17/10* (2006.01)

(52) U.S. Cl.

CPC ..... *D06F 13/08* (2013.01); *D06F 13/06* (2013.01); *D06F 17/10* (2013.01)

(58) Field of Classification Search

CPC ..... D06F 13/06; D06F 13/08; D06F 17/10
USPC ..... 68/23.6–23.7, 53–54, 131–134
See application file for complete search history.

(56) References Cited

U.S. PATENT DOCUMENTS

| | | | | | |
|---|---|---|---|---|---|
| 2,071,622 | A | * | 2/1937 | Gibson | D06F 17/06 366/276 |
| 2,105,218 | A | * | 1/1938 | Kirby | 68/135 |
| 2,186,786 | A | * | 1/1940 | Jensen | 74/18.1 |
| 2,192,758 | A | * | 3/1940 | Skinner | 68/28 |
| 3,952,557 | A | | 4/1976 | Bochan | |
| 4,068,503 | A | | 1/1978 | Platt | |
| 4,329,859 | A | | 5/1982 | Roberts | |
| 4,440,004 | A | | 4/1984 | Bochan | |
| 4,444,027 | A | * | 4/1984 | Ikeda | D06F 37/40 68/133 |

(Continued)

FOREIGN PATENT DOCUMENTS

| | | | |
|---|---|---|---|
| CN | 2140909 | Y | 8/1993 |
| CN | 201254654 | Y * | 6/2009 |

(Continued)

OTHER PUBLICATIONS

Automaticwasher.org, LG top loader, posted photos dated Feb. 15, 2007, (http://www.automaticwasher.org/cgi-bin/TD/TD-VIEWTHREAD.cgi?10448).*

(Continued)

*Primary Examiner* — Michael Barr
*Assistant Examiner* — Kevin G Lee
(74) *Attorney, Agent, or Firm* — Staas & Halsey LLP

(57) ABSTRACT

A pulsator device that generates a composite stream of water to improve performance of a washing machine. The pulsator device includes a first pulsator configured to be rotated about a rotary shaft, a shaft connected to the first pulsator such that the shaft is rotated with the first pulsator, the shaft being eccentric with respect to the rotary shaft, and a second pulsator rotatably coupled to the shaft.

6 Claims, 8 Drawing Sheets

(56) References Cited

U.S. PATENT DOCUMENTS

| | | | | | |
|---|---|---|---|---|---|
| 4,482,161 | A | * | 11/1984 | Izzi, Sr. | E03D 11/16 277/606 |
| 5,460,018 | A | | 10/1995 | Werner et al. | |
| 5,596,891 | A | * | 1/1997 | Bae et al. | 68/133 |
| 5,680,780 | A | * | 10/1997 | Kim et al. | 68/134 |
| 5,865,046 | A | * | 2/1999 | Na et al. | 68/23.6 |
| 5,921,114 | A | * | 7/1999 | Jung | 68/133 |
| 5,950,459 | A | * | 9/1999 | Takagi et al. | 68/23.6 |
| 5,950,460 | A | | 9/1999 | Oh | |
| 6,016,672 | A | * | 1/2000 | Kim et al. | 68/53 |
| 6,115,863 | A | * | 9/2000 | Mason et al. | 8/159 |
| 7,213,423 | B2 | * | 5/2007 | Lim et al. | 68/23.2 |
| 7,331,202 | B2 | * | 2/2008 | Park et al. | 68/23.6 |
| 2003/0061845 | A1 | | 4/2003 | Skvarla et al. | |
| 2003/0154749 | A1 | | 8/2003 | Kim et al. | |
| 2004/0031294 | A1 | * | 2/2004 | Lim et al. | 68/23.2 |

FOREIGN PATENT DOCUMENTS

| | | | | |
|---|---|---|---|---|
| CN | 201258400 | Y | * | 6/2009 |
| EP | 0 668 387 | A1 | | 2/1995 |
| JP | 8-38780 | | | 2/1996 |
| JP | 10071290 | A | * | 3/1998 |
| JP | 10-295975 | | | 11/1998 |
| JP | 2000157775 | A | * | 6/2000 |
| KR | 10-0207362 | | | 4/1999 |
| KR | 2003040661 | A | * | 5/2003 |
| KR | 10-2004-0034235 | | | 4/2004 |
| KR | 10-0444956 | | | 8/2004 |
| KR | 10-0451858 | | | 9/2004 |
| KR | 10-0461872 | | | 12/2004 |
| KR | 10-0480715 | | | 3/2005 |
| KR | 10-0493307 | | | 5/2005 |
| KR | 10-0493308 | | | 5/2005 |
| KR | 792718 | B1 | * | 1/2008 |
| WO | 00/06819 | | | 2/2000 |

OTHER PUBLICATIONS

Machine translation of CN201254654Y, dated Jun. 2009.*

Russian Decision of Grant dated Jun. 15, 2012 issued in corresponding Russian Patent Application No. 2010140034.

European Search Report dated Jan. 26, 2011 and issued in corresponding European Patent Application 10176726.7.

Chinese Office Action issued on Jan. 13, 2014 in corresponding Chinese Application No. 201010501319.4.

Korean Office Action for corresponding Korean Application 10-2009-0100644; dated Sep. 27, 2013.

* cited by examiner

PULSATOR DEVICE USABLE WITH WASHING MACHINE AND WASHING MACHINE HAVING THE SAME

CROSS-REFERENCE TO RELATED APPLICATIONS

This application claims the benefit of Korean Patent Application No. 2009-0100644, filed on Oct. 22, 2009 in the Korean Intellectual Property Office, the disclosure of which is incorporated herein by reference.

BACKGROUND

1. Field

Embodiments relate to a washing machine having a pulsator device that generates a composite stream of water.

2. Description of the Related Art

Generally, a washing machine adopting a pulsator washes laundry using a stream of water generated by the rotation of the pulsator.

The pulsator may generate a strong stream of water to improve washing force of the washing machine. However, when the stream of water is too strong, laundry may be damaged.

The performance of the washing machine is basically decided according to the washing force of the washing machine. If the laundry is damaged during washing, however, the washing machine may not provide users with a good impression although the washing force of the washing machine is excellent.

Meanwhile, an amount of water used to wash laundry is also critical to decide the performance of the washing machine. When an amount of water used to wash the laundry is increased, water supply time and drainage time increase, and therefore, total washing time increases, which is not economical.

SUMMARY

It is an aspect to provide a pulsator device that generates a composite stream of water to improve performance of a washing machine.

In accordance with one aspect, a pulsator device usable with a washing machine includes a first pulsator configured to be rotated about a rotary shaft, a shaft connected to the first pulsator such that the shaft is rotated with the first pulsator, wherein the shaft is eccentric with respect to the rotary shaft, and a second pulsator rotatably coupled to the shaft.

The first pulsator may have a recess formed at an upper part thereof, and the second pulsator may be disposed in the recess.

The shaft may be inclined with respect to the rotary shaft.

The shaft may be disposed such that the shaft is inclined upward toward an outside of the first pulsator in a radial direction thereof.

The pulsator device may further include a connector disposed between the first pulsator and the second pulsator, the connector being fixed to the first pulsator such that the connector is rotated with the first pulsator, wherein the connector may have an inclined surface disposed at a position where the connector deviates from the rotary shaft to one side and inclined with respect to a horizontal direction, and the shaft may extend perpendicularly from the inclined surface.

The recess may be disposed such that the recess deviates to one side of the first pulsator in a radial direction thereof.

The first pulsator may have a side wall to form the recess, and the side wall may have an upper end extending such that the upper end is inclined with respect to a horizontal direction.

The second pulsator may have at least one rib protruding downward from an outer edge thereof.

The side wall may have a step forming part extending toward an inside of the first pulsator in a radial direction thereof.

The at least one rib may include a first rib disposed adjacent to the side wall of the first pulsator and a second rib disposed inside the first rib.

The second pulsator may be inclined with respect to a horizontal direction by an angle of 3 to 10 degrees.

The first pulsator may have at least one water stream forming blade extending from an outside of the recess in a radial direction thereof.

In accordance with another aspect, a washing machine includes a tub, a rotary tub rotatably disposed in the tub, a first pulsator coupled to a drive shaft, at least part of the first pulsator being rotatably disposed in the rotary tub, a shaft connected to the first pulsator such that the shaft is rotated with the first pulsator, the shaft being inclined with respect to the drive shaft, and a second pulsator rotatably coupled to the shaft, the second pulsator being disposed at a top of the first pulsator, wherein the second pulsator is inclined with respect to a horizontal direction.

The top of the first pulsator may extend such that the top of the first pulsator is inclined with respect to the horizontal direction in correspondence to the inclination of the second pulsator.

The first pulsator may have a recess formed at an upper part thereof and a side wall formed around the recess, and the second pulsator may be disposed in the recess.

The shaft may be eccentric with respect to the drive shaft such that the shaft turns around the drive shaft during rotation of the first pulsator.

An upper end of the side wall of the first pulsator and a top of the second pulsator may be connected to each other in substantially the same plane.

The washing machine may further include a connector disposed between the first pulsator and the second pulsator, the connector being fixed to the first pulsator such that the connector is rotated with the first pulsator, wherein the connector may have an inclined surface disposed at a position where the connector deviates from the drive shaft to one side and inclined with respect to a horizontal direction, and the shaft may extend upward from the inclined surface.

In accordance with another aspect, a washing machine includes a tub, a rotary tub rotatably disposed in the tub, a first pulsator configured such that at least part of the first pulsator is rotatably disposed in the rotary tub, the first pulsator having a recess eccentric to one side in a radial direction thereof, a shaft disposed at the first pulsator such that the shaft is rotated with the first pulsator, and a second pulsator rotatably coupled to the shaft, the second pulsator being disposed in the recess of the first pulsator.

In accordance with another aspect, a washing machine includes a tub, a rotary tub rotatably disposed in the tub, a first pulsator configured such that at least part of the first pulsator is rotatably disposed in the rotary tub, the first pulsator having a top inclined with respect to a horizontal direction, a shaft disposed at the top of the first pulsator, and a second pulsator rotatably coupled to the shaft, the second pulsator being disposed in parallel to the inclined top of the first pulsator.

The shaft may be disposed at a position eccentric from a center of rotation of the first pulsator.

The shaft may have an inclined surface formed at a bottom thereof to support the second pulsator, and the inclined surface may have substantially the same angle as the inclined top of the first pulsator.

In accordance with a further aspect, a washing machine includes a first pulsator configured to be rotated about a rotary shaft, a shaft connected to the first pulsator such that the shaft is rotated with the first pulsator, and a second pulsator rotatably coupled to the shaft, the second pulsator having a smaller diameter than the first pulsator, wherein the first pulsator has an outer top formed at an outside of the second pulsator in a radial direction thereof, and the first pulsator is provided at the outer top thereof with a water stream forming blade to generate a rotating stream of water.

The second pulsator may have a top, and the second pulsator may be provided at the top thereof with at least one blade.

The second pulsator may be inclined with respect to a horizontal direction, and the outer top of the first pulsator may be inclined with respect to the horizontal direction.

The shaft may be eccentric with respect to the rotary shaft.

The shaft may be coupled to the second pulsator such that the shaft is perpendicular to the inclined top of the second pulsator.

The second pulsator may be provided at the top thereof with through holes for wash water circulation.

The water stream forming blade may include a plurality of water stream forming blades, and at least one of the water stream forming blades may be larger than the others.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
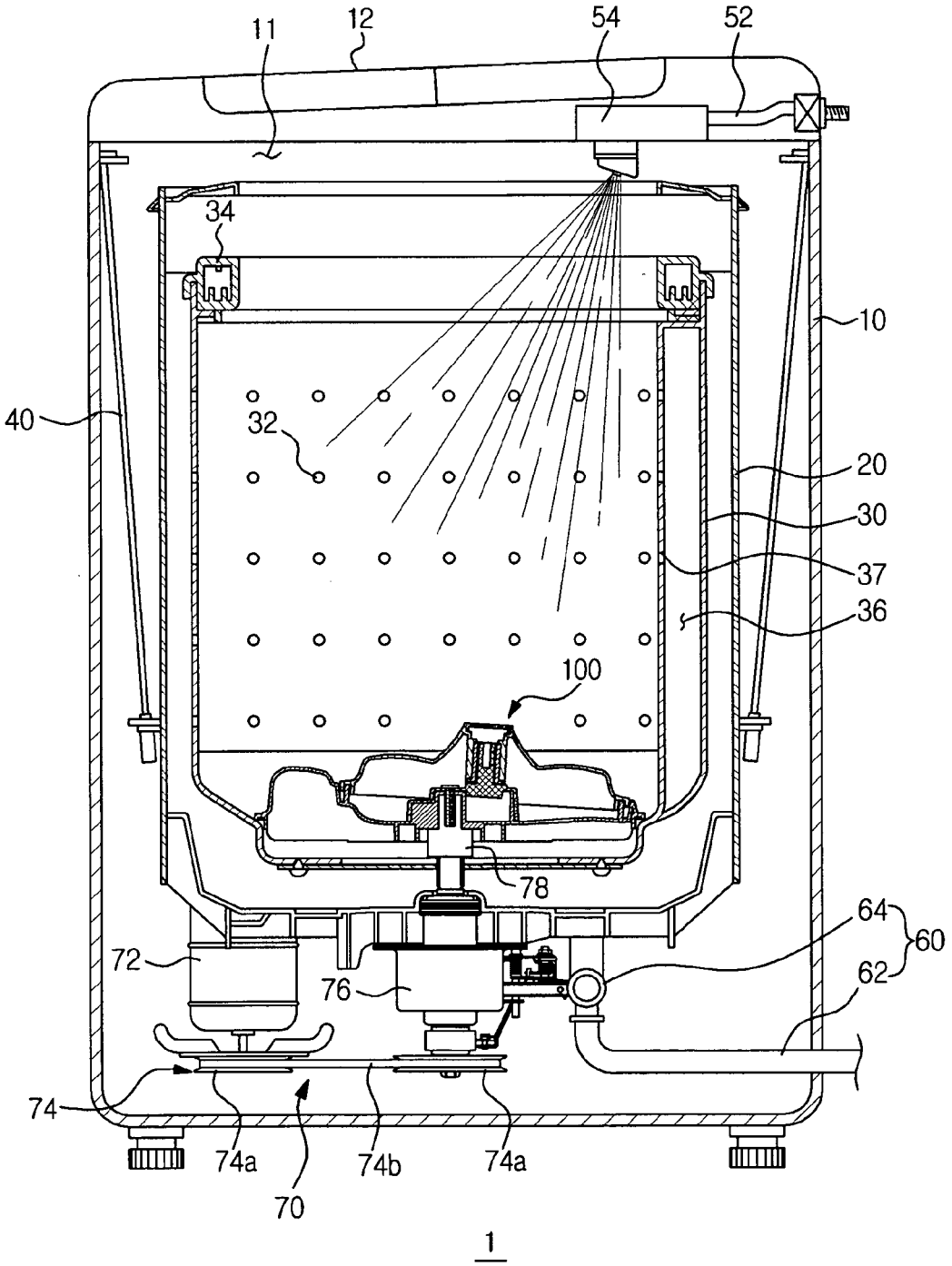
FIG. 1 is a view illustrating a washing machine according to an embodiment.

Reference will now be made in detail to the embodiments, examples of which are illustrated in the accompanying drawings, wherein like reference numerals refer to like elements throughout.

FIG. 1 is a view illustrating a washing machine 1 according to an embodiment. As shown in FIG. 1, the washing machine 1 includes a cabinet 10 constituting the external appearance of the washing machine 1, a tub 20 disposed in the cabinet 10, a rotary tub 30 rotatably disposed in the tub 20, and a pulsator device 100 disposed in the rotary tub 30 to generate a stream of water.

At the top of the cabinet 10 is formed an introduction port 11 through which laundry is introduced into the rotary tub 30. The introduction port 11 is opened and closed by a door 12 mounted at the top of the cabinet 10.

The tub 20 is supported at the cabinet 10 by a suspension device 40 to connect the outer lower side of the tub 20 and the inner upper side of the cabinet 10.

Above the tub 20 is mounted a water supply pipe 52 to supply wash water into the tub 20. One side of the water supply pipe 52 is connected to an external water supply source (not shown), and the other side of the water supply pipe 52 is connected to a detergent supply device 54. Water supplied through the water supply pipe 52 passes through the detergent supply device 54 such that the water is supplied into the tub 20 together with a detergent.

Below the tub 20 is mounted a drainage device 60 to discharge wash water from the tub 20 out of the washing machine 1. The drainage device 60 may include a drainage pipe 62 connected to the bottom of the tub 20 and a drainage valve 64 mounted on the drainage pipe 62. In the drainage pipe 62 may be mounted a drainage pump (not shown) to forcibly discharge wash water from the tub 20.

The rotary tub 30 is configured in the form of a cylinder open at the top thereof. A plurality of spin-drying holes 32 are formed at the circumference of the rotary tub 30. At the top of the rotary tub 30 may be mounted a balancer 34 by which the rotary tub 39 is kept stable during high speed rotation. Inside the rotary tub 30 is mounted a pumping duct 36 to circulate wash water in the rotary tub 30. The pumping duct 36 has discharge ports 37 to discharge wash water.

Below the tub 20 is mounted a drive device 70. The drive device 70 includes a motor 72, a power transmission device 74, a clutch 76, and a drive shaft 78. The drive shaft 78 is coupled to the pulsator device 100 to transmit power from the motor 72 to the pulsator device 100.

Power from the motor 72 is transmitted to the clutch 76 via the power transmission device 74. The power transmission device 74 may include pulleys 74*a* and a belt 74*b* connecting the pulleys 74*a*. The clutch 76 intermits power from the motor 72 such that the rotary tub 30 and the pulsator device 100 are rotated together or the pulsator device 100 is rotated while the rotary tub 30 is stopped.

Figure 2:
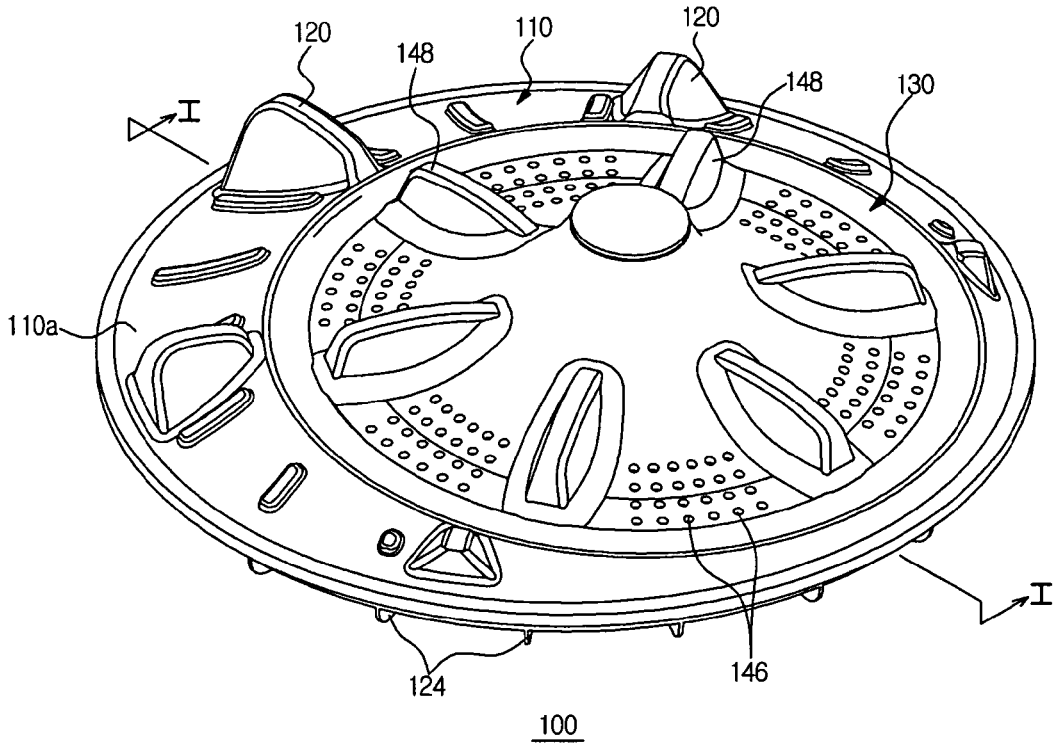
FIGS. 2 and 3 are assembled and exploded perspective views illustrating a pulsator device according to an embodiment.
Figure 3:
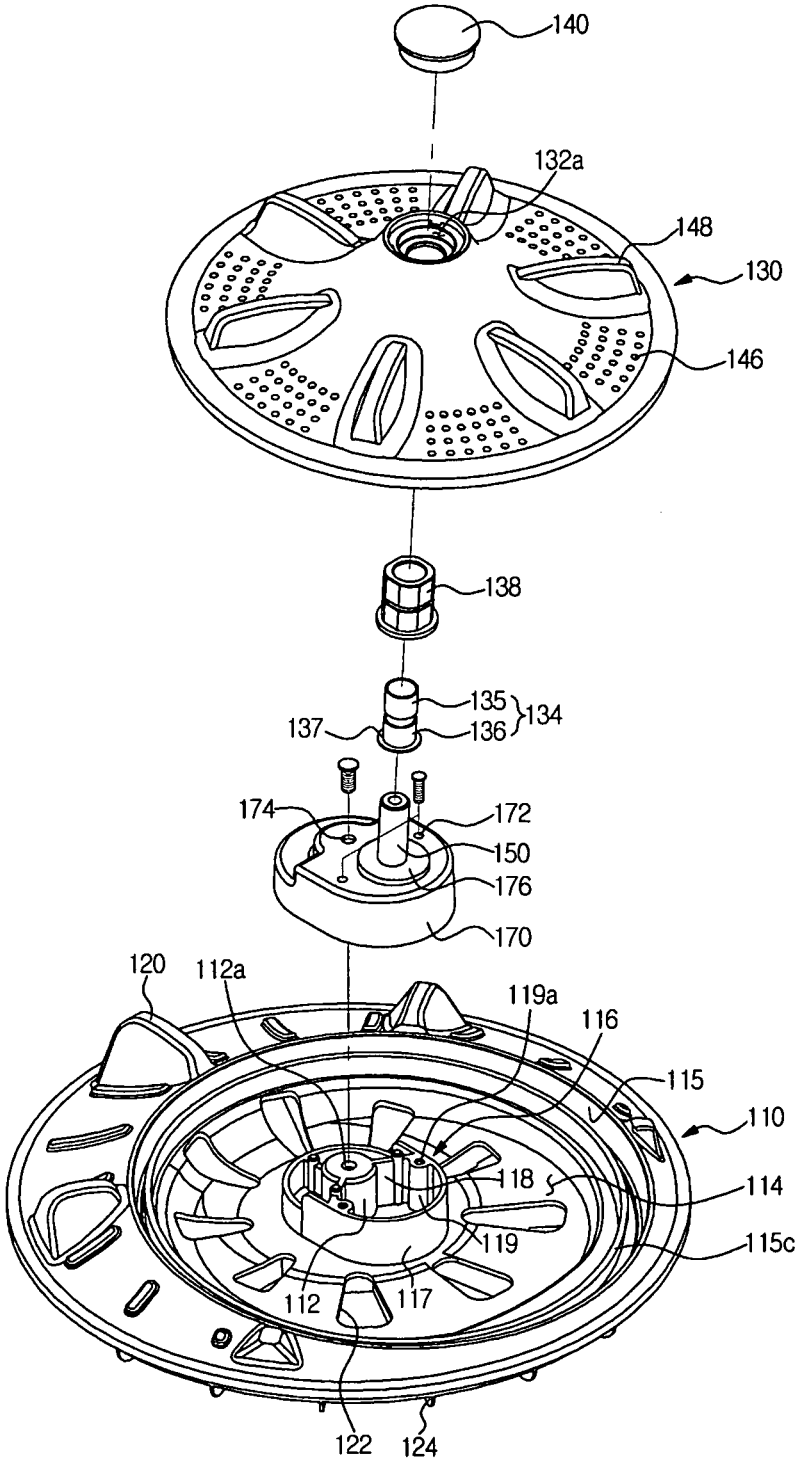
Figure 4:
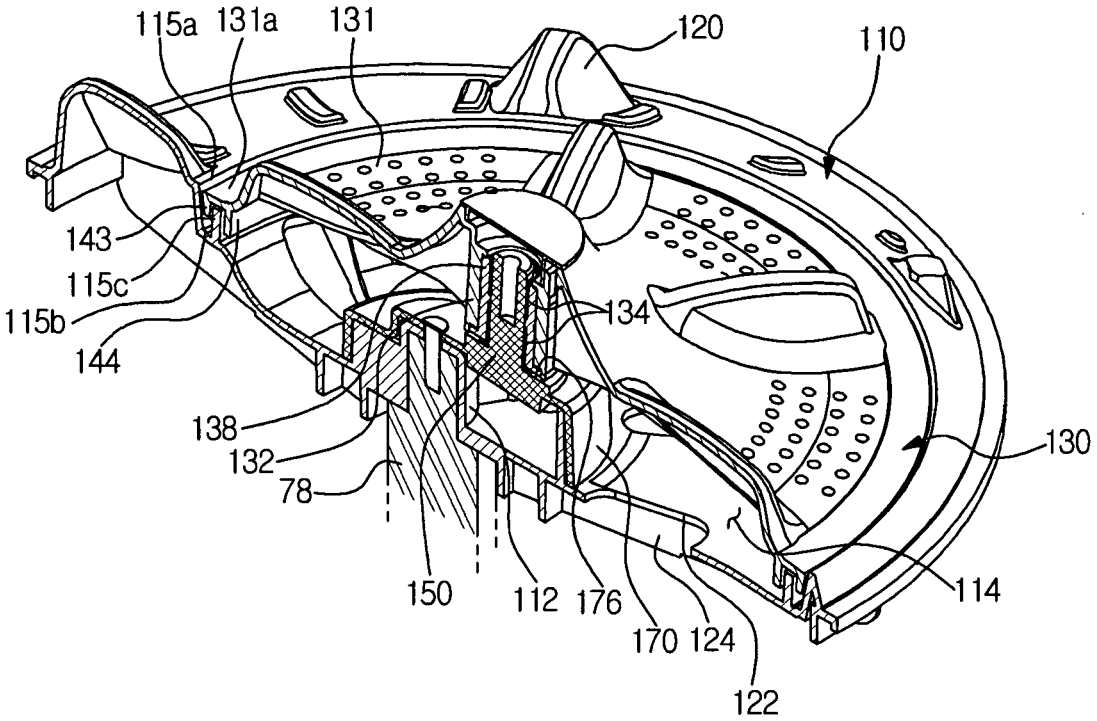
FIG. 4 is a sectional view taken along line I-I of FIG. 2.

FIGS. 2 and 3 are assembled and exploded perspective views illustrating a pulsator device 100 according to an embodiment. FIG. 4 is a sectional view taken along line I-I of FIG. 2.

As shown in FIGS. 1 to 4, the pulsator device 100 includes a first pulsator 110, a second pulsator 130, and a shaft 150.

At least part of the first pulsator 110 is disposed in the rotary tub 30. The pulsator 110 is rotatably mounted at the bottom of the rotary tub 30. The first pulsator 110 has a shaft coupling part 112 formed at the center thereof. The drive shaft 78 is coupled to the shaft coupling part 112.

The drive shaft 78 serves as a rotary shaft of the first pulsator 110. When power from the motor 72 is transmitted to the drive shaft 78 via the clutch 76, the first pulsator 110 is rotated about the drive shaft 78.

A recess 114 is formed at the upper part of the first pulsator 110. A side wall 115 is formed around the recess 114. The recess 114 may be disposed such that the recess 114 deviates to one side of the first pulsator 110 in the radial direction thereof.

The shaft 150 is connected to the first pulsator 110 such that the shaft 150 is rotated with the first pulsator 110. The shaft 150 may be connected to the first pulsator 110 via a connector 170. Alternatively, the shaft 150 may be directly coupled to the first pulsator 110 without an additional part to connect the shaft 150 and the first pulsator 110.

A connector coupling part 116 connected to the connector 170 is provided in the recess 114 of the first pulsator 110. The connector coupling part 116 has a guide rib 117 protruding upward from the bottom of the recess 114. The guide rib 117 serves to guide the coupling position of the connector and to stably support the inside of the connector 170 in a state in which the connector 170 is coupled.

A shaft coupling part 112 is disposed inside the guide rib 117. The shaft coupling part 112 is connected to the guide rib 117 by reinforcement ribs 118.

One or more coupling bosses 119 are provided at the connector coupling part 116. A coupling hole 119*a* is formed at each of the coupling bosses 119. Meanwhile, a through hole 112*a* coupling the connector 170 and the drive shaft 78 may be formed at the top of the shaft coupling part 112.

The connector 170 is disposed between the first pulsator 110 and the second pulsator 130. The connector 170 is coupled to the first pulsator 110 such that the connector 170 is rotated with the first pulsator 110. The connector 170 is fixed to the first pulsator 110 by a coupling member such as a bolt. To this end, the connector 170 has coupling holes 172 and 174 corresponding respectively to the coupling holes 119*a* of the connector coupling part 116 and the through hole 112*a* of the shaft coupling part 112.

When the connector 170, the first pulsator 110 and the drive shaft 78 are coupled using a single coupling member inserted through the coupling hole 174 of the connector 170 and the through hole 112*a* of the shaft coupling part 112, secure coupling of the respective components 170, 110 and 78 is achieved while the number of coupling points is reduced.

Figure 5:
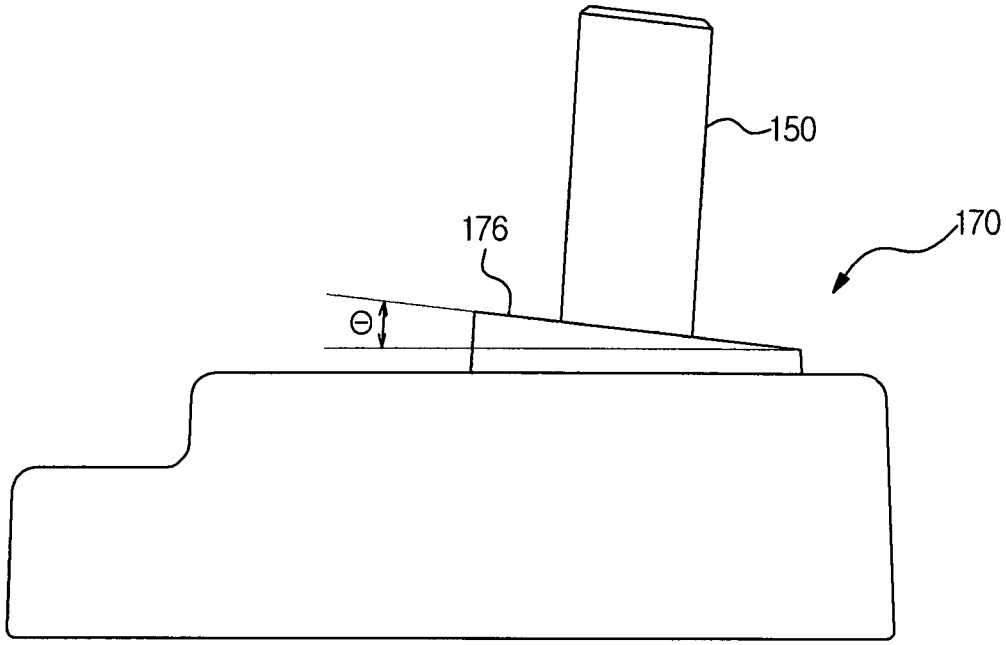
FIG. 5 is a front view illustrating a connector of the pulsator device according to the embodiment.
Figure 6:
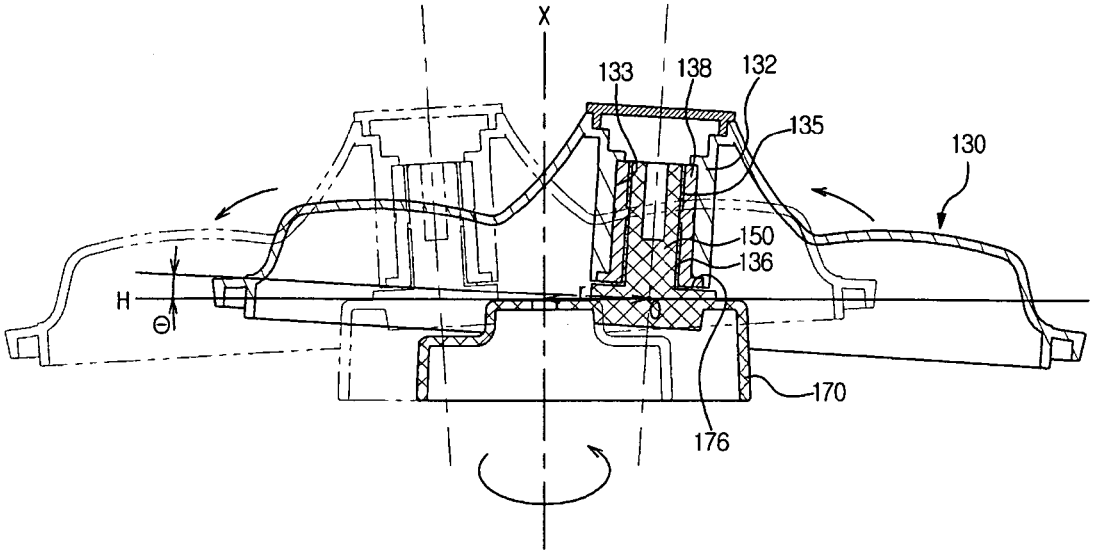
FIG. 6 is a sectional view illustrating a second pulsator and the connector of the pulsator device according to the embodiment.
Figure 7:
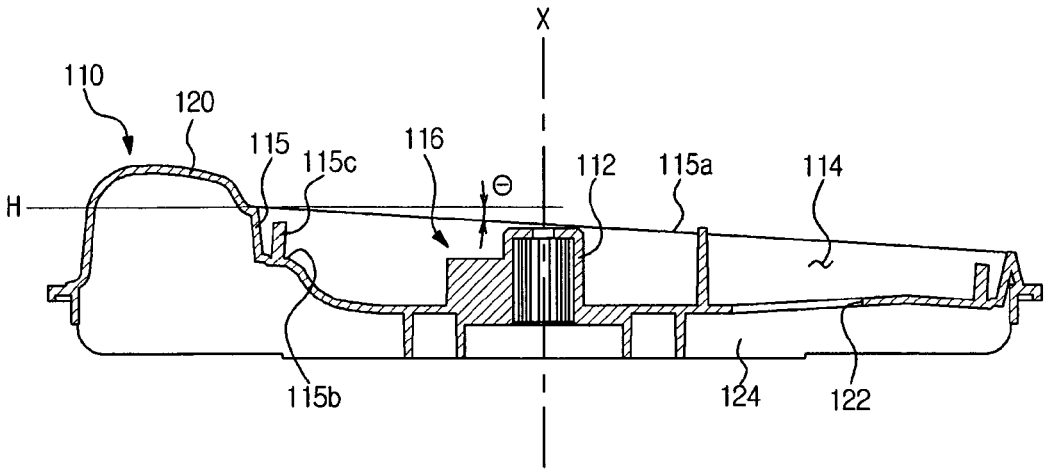
FIG. 7 is a sectional view illustrating a first pulsator of the pulsator device according to the embodiment.

FIG. 5 is a front view illustrating the connector of the pulsator device according to the embodiment of the present invention. FIG. 6 is a sectional view illustrating the second pulsator and the connector of the pulsator device according to the embodiment. FIG. 7 is a sectional view illustrating the first pulsator of the pulsator device according to the embodiment.

As shown in FIGS. 3 to 7, the shaft 150 is eccentric with respect to the drive shaft 78. In this structure, the shaft 150 turns around an axis X of the drive shaft 78 during the rotation of the first pulsator 110.

Also, the shaft 150 may be inclined with respect to the drive shaft 78. In this case, the second pulsator 130 coupled to the shaft 150 is inclined with respect to the horizontal direction, with the result that an arbitrary point of the second pulsator 130 moves up and down during the rotation of the first pulsator 110.

The shaft 150 may be disposed such that the shaft 150 is inclined upward toward the outside of the first pulsator 110 in the radial direction thereof. Alternatively, the shaft 150 may be disposed such that the shaft 150 is inclined upward toward the inside of the first pulsator 110 in the radial direction thereof, i.e., toward the drive shaft 78. However, the shaft 150 is disposed such that the shaft 150 is inclined upward toward the outside of the first pulsator 110 in the radial direction thereof so as to increase the distance between the center O of the second pulsator 130 and the axis X of the drive shaft 78, i.e., a turn radius r (see FIG. 6) of the second pulsator 130.

The shaft 150 may be integrated with the connector 170. As shown in FIGS. 5 and 6, the connector 170 has an inclined surface 176 disposed at a position where the connector 170 deviates from the drive shaft 78 to one side and inclined with respect to the horizontal direction. The inclined surface 176 may be inclined downward by a predetermined angle θ along a direction in which the inclined surface 176 is distant from the drive shaft 78.

Meanwhile, the connector 170 may be disposed at a position where the connector 170 deviates from the drive shaft 78 to one side, and the shaft 150 may be vertically formed, such that the second pulsator 130 is horizontally disposed. That is, the angle of the inclined surface of the connector 170 coupled to the second pulsator 130 may be set to 0 such that second pulsator 130 is horizontally disposed.

The shaft 150 extends upward from the inclined surface 176 of the connector 170. The shaft 150 may extend from the inclined surface 176 such that the shaft 150 is perpendicular to the inclined surface 176. Therefore, the shaft 150 is disposed such that the shaft 150 is eccentric with respect to the drive shaft 78 and is inclined upward in the direction in which the shaft 150 is distant from the drive shaft 78. On the other hand, the shaft 150 may not be inclined with respect to the vertical direction.

The second pulsator 130 is rotatably coupled to the shaft 150. The second pulsator 130 is not constrained by the shaft 150 such that the second pulsator 130 and the shaft 150 are rotated relative to each other.

A coupling boss 132 having a shaft coupling hole 133, through which the shaft 150 is inserted, is disposed at the center of the second pulsator 130. The coupling boss 132 is supported at the inclined surface 176 of the connector 170.

A bearing 134 may be disposed between the inside of the shaft coupling hole 133 and the shaft 150 such that the second pulsator 130 is smoothly rotated relative to the shaft 150. A bearing housing 138 may be fixed inside the shaft coupling hole 133, and the bearing 134 may be fixed to the inside of the bearing housing 138. The bearing 134 may be an oilless bearing.

The bearing 134 may include an upper bearing 135 fixed to the upper part of the bearing housing 138 and a lower bearing 136 fixed to the lower part of the bearing housing 138. When the bearing 134 is constituted by two parts as described above, ease of assembly and assembly accuracy of the bearing 134 are improved. The lower bearing 136 has a flange 137 disposed between the bottom of the coupling boss 132 and the inclined surface 176 of the connector. The coupling boss 132 of the second pulsator 130 is smoothly rotated on the inclined surface 176 of the connector 170 by the flange 137.

Meanwhile, a cap receiving part 132*a* is provided at the top of the coupling boss 132 of the second pulsator 130. A cap 140 may be mounted at the cap receiving part 132*a*.

The second pulsator 130 is disposed in the recess 114 formed at the first pulsator 110 such that the recess 114 is inclined with respect to the horizontal direction. An example in which the second pulsator 130 is inclined by an angle θ with respect to a horizontal direction H is illustrated in FIG. 6.

When the second pulsator 130 is disposed in an inclined state, an arbitrary point of the top of the second pulsator 130 moves up and down during the rotation of the first pulsator 110. This movement of the second pulsator 130 generates an up and down stream of water in the rotary tub 30.

The angle θ by which the second pulsator 130 is inclined with respect to the horizontal direction decides a range of up and down movement of the second pulsator 130. When the angle θ is large, the second pulsator 130 generates a strong up and down stream of water. When the angle θ is too large, however, laundry may deviate to one side of the rotary tub 30 during washing. Therefore, the angle θ may be 10 degrees of less. On the other hand, when the angle θ is too small, the up and down movement of the second pulsator 130 is slight, with the result that an up and down stream of water is not effectively generated. Therefore, the angle θ may be 3 degrees or more.

In another embodiment, the first pulsator and the second pulsator may be disposed parallel to each other by disposing the first pulsator and the second pulsator such that the first pulsator and the second pulsator are inclined with respect to the horizontal direction and providing the first pulsator and the second pulsator with the same inclination angle.

However, the second pulsator may be horizontally disposed irrespective of the inclination of the first pulsator. Also, the first pulsator may be horizontally disposed irrespective of the inclination of the second pulsator.

As shown in FIGS. 4 and 7, an upper end 115*a* of the side wall 115 of the first pulsator 110 extends such that the upper end 115*a* is inclined with respect to the horizontal direction in correspondence to the inclination of the second pulsator 130. A portion 131*a*, adjacent to the upper end 115*a* of the side wall 115, of the top 131 of second pulsator 130 is formed so as to be smoothly connected to the upper end 115*a* of the side wall 115.

That is, the portion 131*a* of the second pulsator 120 may connected to the upper end 115*a* of the side wall without a large step although the portion 131*a* of the second pulsator 120 is located higher or lower than the upper end 115*a* of the side wall. Also, the portion 131*a* of the second pulsator 120 may be disposed in substantially the same plane as the upper end 115*a* of the side wall. The top of the second pulsator 130 corresponding to the top of the first pulsator 110 may be disposed approximately 2 mm lower than the top of the first pulsator 110. In this structure, laundry or foreign matter may be prevented from being caught between the side wall 115 of the first pulsator 110 and the second pulsator 130.

The side wall 115 of the first pulsator 110 has a step forming part 115*b* extending toward the inside of the first pulsator 110 in the radial direction thereof. The second pulsator 130 has ribs 143 and 144 protruding from the outer edge thereof toward the step forming part 115*b*. The step forming part 115*b* and the ribs 143 and 144 further prevent laundry or foreign matter from being caught between the side wall 115 of the first pulsator 110 and the second pulsator 130. Although foreign matter is caught between the side wall 115 of the first pulsator 110 and the second pulsator 130, the step forming part 115*b* and the ribs 143 and 144 prevent the foreign matter from being introduced to the lower part of the second pulsator 130.

The ribs may include a first rib 143 disposed adjacent to the side wall 115 of the first pulsator 110 and a second rib 144 disposed inside the first rib 143 while being spaced apart from the first rib 143 by a predetermined distance.

To further improve such a function to prevent the introduction of foreign matter, a protrusion 115*c* may be formed at the side wall 115 of the first pulsator 110. The protrusion 115*c* is disposed adjacent to the first rib 143 or the second rib 144 of the second pulsator 130 and protrudes toward the second pulsator 130. The protrusion 115*c* may protrude between the first rib 143 and the second rib 144 of the second pulsator 130.

As shown in FIGS. 2 and 3, the second pulsator 130 has through holes 146 for wash water circulation. Wash water adjacent to the second pulsator 130 may be introduced to the lower part of the second pulsator 130 through the through holes 146.

Also, the second pulsator 130 has blades 148 protruding from the top thereof. The blades 148 are disposed in the circumferential direction of the second pulsator 130. The blades 148 rub against laundry such that the laundry hinders the second pulsator 130 from rotating (rotating about the shaft 150).

Water stream forming blades 120 are disposed in the circumferential direction of the first pulsator 110. Each of the water stream forming blades 120 protrudes from the top 110*a* of the first pulsator 110 and extends from the outside of the recess 114 in the radial direction thereof. The water stream forming blades 120 generate a rotating stream of water during the rotation of the first pulsator 110.

Holes 122 are disposed at the recess 114 of the first pulsator 110 in the circumferential direction thereof. A plurality of pumping blades 124 are radially disposed at the rear of the first pulsator 110. During washing of laundry, wash water adjacent to the first pulsator 110 is introduced toward the rear of the first pulsator 110 through the holes 122 of the first pulsator 110, and is pushed to the outside of the first pulsator 110 in the radial direction thereof by the pumping blades 124. The wash water, pushed by the pumping blades 124, is guided to the pumping duct 36 (see FIG. 1) through a flow channel (not shown) formed at the lower part of the rotary tub 30, and is discharged into the rotary tub 30 through the discharge ports 37 of the pumping duct 36.

Figure 8:
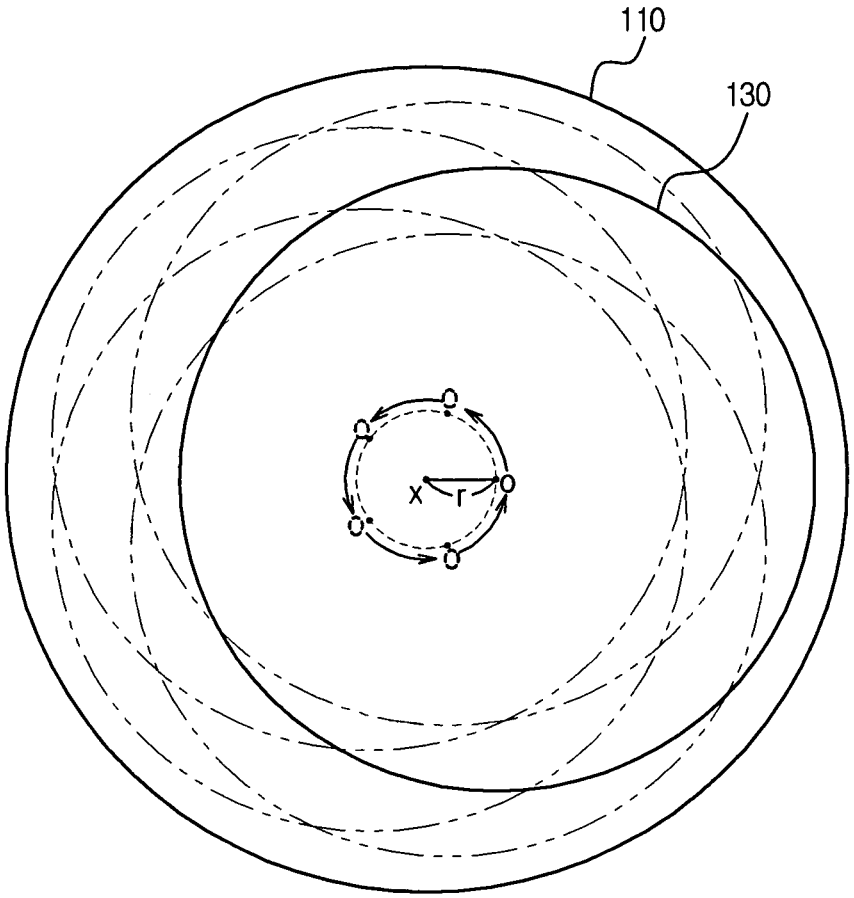
FIG. 8 is a view illustrating the operation of the pulsator device in the washing machine according to the embodiment.

Hereinafter, the operation of the washing machine according to the embodiment will be described with reference to FIGS. 1 and 6 to 8. FIG. 8 is a view illustrating the operation of the pulsator device in the washing machine according to the embodiment.

When a user puts laundry into the rotary tub 30, puts a detergent into the detergent supply device 54, and operates the washing machine 1, wash water is supplied into the rotary tub 30 through the water supply pipe 52. When the water supply operation is completed, the motor 72 is operated to drive the pulsator device 100.

Power from the motor 72 rotates the first pulsator 110 through the drive shaft 78. When the first pulsator 110 is rotated, a rotating stream of water is generated by the water stream forming blades 120 disposed at the top of the first pulsator 110.

Since the second pulsator 130 is disposed on the first pulsator 110 in an inclined state, an arbitrary point at the top of the second pulsator 130 moves up and down during the rotation of the first pulsator 110, with the result that an up and down stream of water is generated in the rotary tub 30.

That is, when the first pulsator 110 is rotated, the shaft 150 connected to the first pulsator 110 via the connector 170 turns around the axis X of the drive shaft 78. At this time, when the weight of the laundry in the rotary tub 30 is applied to the second pulsator 130, and therefore, the rotation of the second pulsator 130 is restricted, the shaft 150 is rotated relative to the second pulsator 130, and an arbitrary point at the top of the second pulsator 130 moves up and down to generate a stream of water.

Since the shaft 150 is rotated relative to the second pulsator 130 when a load of the laundry is applied to the second pulsator 130, the load applied to the second pulsator 120 is not transmitted to the motor 72. Consequently, a load of the motor 72 is reduced.

Meanwhile, since the center O of the second pulsator 130 is eccentric with respect to the drive shaft 78, as shown in FIG. 8, the second pulsator 130 turns around the drive shaft

78 with a radius r corresponding to the distance between the center O of the second pulsator 130 and the axis X of the drive shaft 78 during the rotation of the first pulsator 110 to generate an up and down stream of water as shown in FIG. 6.

In this way, the pulsator device 100 according to the embodiment generates a composite stream of water through the rotating movement of the first pulsator 110, the up and down movement of the second pulsator 130, and the turning movement of the second pulsator 130, thereby effectively washing laundry using a small amount of water and preventing the laundry from being damaged by a strong stream of water.

As is apparent from the above description, laundry is effectively washed using a small amount of water using the pulsator device that generates a composite stream of water, and the laundry is prevented from being damaged by a strong stream of water.

Also, the laundry is prevented from being caught in the pulsator device and thus being damaged during washing.

Also, the laundry may turn upside down in the rotary tub by the rotating movement of the first pulsator, the up and down movement of the second pulsator, and the turning movement of the second pulsator.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a tub;

a rotary tub rotatably disposed in the tub;

a first pulsator coupled to a drive shaft, at least part of the first pulsator being rotatably disposed in the rotary tub, the first pulsator having a recess around the drive shaft, the recess formed eccentric to the drive shaft;

a shaft connected to the first pulsator such that the shaft revolves around the drive shaft, the shaft being inclined with respect to the drive shaft toward an outside of the first pulsator in a radial direction away from the drive shaft; and a second pulsator rotatably coupled to the shaft, the second pulsator being disposed in the recess of the first pulsator, wherein the second pulsator is inclined with respect to a horizontal direction, an inner periphery of the first pulsator is in a same plane as an outer periphery of the second pulsator, and the same plane is inclined with respect to the horizontal direction.

2. The washing machine according to claim 1, wherein a top of the first pulsator extends such that the top of the first pulsator is inclined with respect to the horizontal direction in correspondence to the inclination of the second pulsator.

3. The washing machine according to claim 1, wherein the shaft is eccentric with respect to the drive shaft such that the shaft turns around the drive shaft during rotation of the first pulsator.

4. The washing machine according to claim 1, wherein the inner periphery of the first pulsator and the outer periphery of the second pulsator contact each other in the same plane.

5. The washing machine according to claim 1, further comprising:

a connector disposed between the first pulsator and the second pulsator, the connector being fixed to the first pulsator such that the connector is rotated with the first pulsator, wherein the connector has an inclined surface disposed at a position where the connector deviates from the drive shaft to one side and inclined with respect to the horizontal direction, and the shaft extends upward from the inclined surface.

6. The washing machine according to claim 1, wherein the second pulsator is configured to rotate on the shaft freely with respect to the shaft such that a rotational orientation of the second pulsator with respect to the tub is maintainable by laundry supported on the second pulsator while the shaft revolves around the drive shaft.

* * * * *